US008869766B2

(12) United States Patent
Burrows

(10) Patent No.: US 8,869,766 B2
(45) Date of Patent: Oct. 28, 2014

(54) CORONA IGNITION SYSTEM HAVING SELECTIVE ENHANCED ARC FORMATION

(71) Applicant: Federal-Mogul Ignition Company, Southfield, MI (US)

(72) Inventor: John Antony Burrows, Altrincham (GB)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 14/271,817

(22) Filed: May 7, 2014

(65) Prior Publication Data

US 2014/0238366 A1 Aug. 28, 2014

Related U.S. Application Data

(63) Continuation of application No. 13/349,921, filed on Jan. 13, 2012, now Pat. No. 8,726,871.

(60) Provisional application No. 61/432,274, filed on Jan. 13, 2011.

(51) Int. Cl.

| | |
|---|---|
| ***F02P 23/04*** | (2006.01) |
| ***F02P 15/10*** | (2006.01) |
| ***H01T 13/50*** | (2006.01) |

(52) U.S. Cl.

CPC ..... *H01T 13/50* (2013.01); *F02P 15/10* (2013.01); *F02P 23/04* (2013.01)

USPC ..... 123/143 B

(58) Field of Classification Search

USPC ..... 123/143 B

See application file for complete search history.

(56) References Cited

U.S. PATENT DOCUMENTS

| | | | |
|---|---|---|---|
| 3,974,412 | A | 8/1976 | Pratt |
| 4,448,181 | A | 5/1984 | Ishikawa et al. |
| 4,631,451 | A | 12/1986 | Anderson et al. |
| 4,727,891 | A | 3/1988 | Schmidt et al. |
| 5,179,928 | A | 1/1993 | Cour et al. |
| 5,197,448 | A | 3/1993 | Porreca et al. |
| 5,471,362 | A | 11/1995 | Gowan |
| 5,568,801 | A | 10/1996 | Paterson et al. |
| 5,638,799 | A | 6/1997 | Kiess et al. |
| 5,886,476 | A | 3/1999 | Skinner et al. |
| 6,553,981 | B1 | 4/2003 | Suckewer et al. |

(Continued)

FOREIGN PATENT DOCUMENTS

DE 10207446 A1 7/2003

*Primary Examiner* — Erick Solis

(74) *Attorney, Agent, or Firm* — Robert L. Stearns; Dickinson Wright, PLLC

(57) ABSTRACT

A corona discharge (24) ignition includes an electrode (38) emitting a radio frequency electric field and providing a corona discharge (24) to ignite a combustible mixture. The system includes a controlled high voltage energy supply (52) providing energy to a main energy storage (28) at a first main voltage. A fixed high voltage energy supply (54) provides extra energy to an extra energy storage (26) at a second extra voltage, which is greater than the first main voltage. While the corona discharge (24) is being provided, the energy of the main energy storage (28), but not the extra energy storage (26), is provided to the electrode (38). When the corona discharge (24) switches to arc discharge, the extra energy of the extra energy storage (26) is provided to the corona igniter (22) to enhance the arc discharge and provide reliable ignition until the corona discharge (24) is restored.

11 Claims, 3 Drawing Sheets

(56) References Cited

U.S. PATENT DOCUMENTS

| | | | | |
|---|---|---|---|---|
| 6,609,507 | B2 | 8/2003 | Wilkinson | |
| 7,121,270 | B1 | 10/2006 | Plotnikov | |
| 8,154,843 | B2 | 4/2012 | Roscoe et al. | |
| 8,342,147 | B2 * | 1/2013 | Nouvel et al. | 123/143 B |
| 8,468,992 | B2 | 6/2013 | Ruan et al. | |
| 8,656,880 | B2 * | 2/2014 | Makarov et al. | 123/143 B |
| 2009/0107439 | A1 | 4/2009 | Schultz | |
| 2010/0212620 | A1 | 8/2010 | Shimizu | |
| 2010/0251995 | A1 * | 10/2010 | Nouvel et al. | 123/406.19 |
| 2010/0282198 | A1 * | 11/2010 | Hampton et al. | 123/143 B |
| 2011/0197865 | A1 | 8/2011 | Hampton | |

* cited by examiner

CORONA IGNITION SYSTEM HAVING SELECTIVE ENHANCED ARC FORMATION

CROSS REFERENCE TO RELATED APPLICATION

This Continuation Patent Application claims priority to U.S. Utility patent application Ser. No. 13/349,921, filed Jan. 13, 2012, which claims the benefit of U.S. Provisional Application No. 61/432,274, filed Jan. 13, 2011, which are each incorporated herein by reference in their entirety.

BACKGROUND OF THE INVENTION

1. Field of the Invention

This invention relates generally to a corona ignition system and method for igniting a combustion mixture of fuel and air in a combustion chamber.

2. Related Art

Corona discharge ignition systems provide an alternating voltage and current, reversing high and low potential electrodes in rapid succession which makes arc discharge formation difficult and enhances the formation of corona discharge. The system includes a corona igniter with an electrode charged to a high radio frequency voltage potential and creating a strong radio frequency electric field in a combustion chamber. The electric field causes a portion of a mixture of fuel and air in the combustion chamber to ionize and begin dielectric breakdown, facilitating combustion of the fuel-air mixture. During typical operation of the corona discharge ignition system, the electric field is controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. The corona discharge has a low current and can provide a robust ignition without requiring a high amount of energy and without causing significant wear to physical components of the ignition system. An example of a corona discharge ignition system is disclosed in U.S. Pat. No. 6,883,507 to Freen.

It is typically desirable to control the electric field so that the fuel-air mixture does not lose all dielectric properties, which would create a thermal plasma and an electric arc discharge between the electrode and grounded cylinder walls, piston, or other portion of the corona igniter. However, arc discharge oftentimes occurs, either intentionally or unintentionally, due to the high voltage required to produce the corona discharge and also due to changing engine operating conditions. The duration and intensity of the arc discharge in the corona ignition system is typically not great enough to provide reliable ignition of the combustible mixture.

SUMMARY OF THE INVENTION AND ADVANTAGES

One aspect of the invention provides a corona discharge ignition system for igniting a combustible mixture of fuel and air in a combustion chamber. The system includes an electrode for receiving energy at a radio frequency voltage and emitting a radio frequency electric field to ionize the combustible mixture and provide a corona discharge igniting the combustible mixture. A main energy storage stores energy at a first main voltage and provides the energy ultimately to the electrode. An extra energy storage also stores energy at a second extra voltage. The second extra voltage is greater than the first main voltage. The energy from the extra energy storage is provided, ultimately, to the electrode only when arc discharge occurs to enhance the arc discharge.

Another aspect of the invention provides a method for igniting a combustible mixture of fuel and air in a combustion chamber. The method includes storing energy in the main energy storage at the first main voltage, and providing the energy from the main energy storage ultimately to the electrode allowing the electrode to emit a radio frequency electric field to ionize the combustible mixture and provide the corona discharge igniting the combustible mixture. The method also includes storing energy in the extra energy storage at the second extra voltage. The second extra voltage is greater than the first main voltage. The method further includes providing the energy from the extra energy storage to the electrode only when arc discharge occurs to enhance the arc discharge.

When the corona discharge switches to arc discharge during operation of the corona discharge ignition system, the energy provided to the corona igniter by the main energy supply alone is typically not enough to provide the arc discharge with a duration and strength great enough to reliably ignite the combustible mixture. Thus, when the arc discharge occurs, the extra energy storage provides the extra energy to the corona igniter, supplementing the energy provided by the main energy storage, to enhance the arc discharge and provide a robust, reliable ignition of the combustible mixture.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
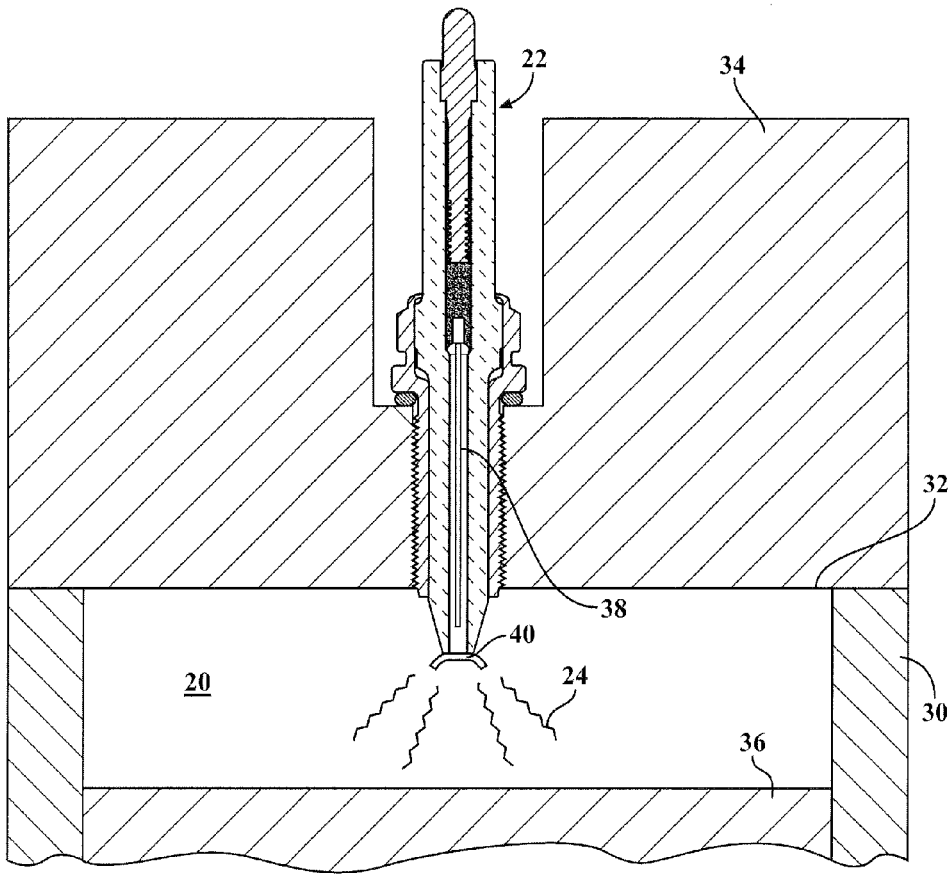
FIG. 1 is a cross-sectional view of a corona igniter disposed in a combustion chamber of a corona discharge ignition system according to one embodiment of the invention.

One aspect of the invention provides a corona ignition system for igniting a combustible mixture of fuel and air in a combustion chamber 20. The system comprises a firing end assembly including a corona igniter 22 typically providing a corona discharge 24 to ignite the combustible mixture. The system includes an improved energy storage and delivery feature, comprising an extra energy storage 26, in addition to a main energy storage 28, to improve reliability of ignition when the corona discharge 24 switches to arc discharge. Extra energy at an increased voltage is applied to the corona igniter 22 when the arc discharge occurs, enhancing the arc discharge to a level capable of igniting the combustible mixture. Thus, the system can provide reliable ignition during the duration of the arc discharge, over one or more ignition cycles, and until the corona discharge 24 is restored.

Under normal operating conditions, the main energy storage 28 stores and provides energy at a first main voltage ultimately to the corona igniter 22 while the extra energy storage 26 stores energy at a second extra voltage greater than the first main voltage. As long as corona discharge 24 is being provided by the corona igniter 22 and efficiently igniting the combustible mixture, the extra energy storage 26 does not provide the extra energy to the corona igniter 22. However, when the corona discharge 24 switches to arc discharge, the extra energy storage 26 provides the extra energy to the corona igniter 22 to enhance the arc discharge. The enhanced arc discharge is strong enough to provide a reliable ignition until the corona discharge 24 is restored. The extra energy storage 26 allows the voltage applied to the corona igniter 22 to be rapidly increased in the case arc discharge is detected. The large discharge of energy to the corona igniter 22 when the arc discharge occurs offsets the reduced ignition efficiency of arc discharge over corona discharge 24. After the large discharge of energy, the energy storages 26, 28 are recharged and ready to use in case of the next arc discharge event.

The corona ignition system is typically employed in an internal combustion engine of an automotive vehicle (not shown). As shown in FIG. 1, the engine includes a cylinder block 30 having a side wall extending circumferentially around a cylinder center axis and presenting a space therebetween. The side wall has a top end 32 surrounding a top opening. A cylinder head 34 is disposed on the top end 32 and extends across the top opening. A piston 36 is disposed in the space along the side wall of the cylinder block 30 for sliding along the side wall during operation of the engine. The piston 36 is spaced from the cylinder head 34 such that the cylinder block 30 and the cylinder head 34 and the piston 36 provide a combustion chamber 20 therebetween.

The corona igniter 22 extends transversely into the combustion chamber 20 and includes an electrode 38 receiving the energy. During typical operating of the corona ignition system, the energy received by the electrode 38 has a radio frequency of 0.5 to 2.0 megahertz, an AC voltage of 10 to 100 kilo volts, and a current below 10 amperes. The electrode 38 then emits a radio frequency electric field at a current of not greater than 10 milliAmperes to ionize a portion of the fuel-air mixture and form the corona discharge 24, which ignites the fuel-air mixture. As shown in FIG. 1, the electrode 38 can include a firing tip 40 emitting the corona discharge 24.

Figure 2:
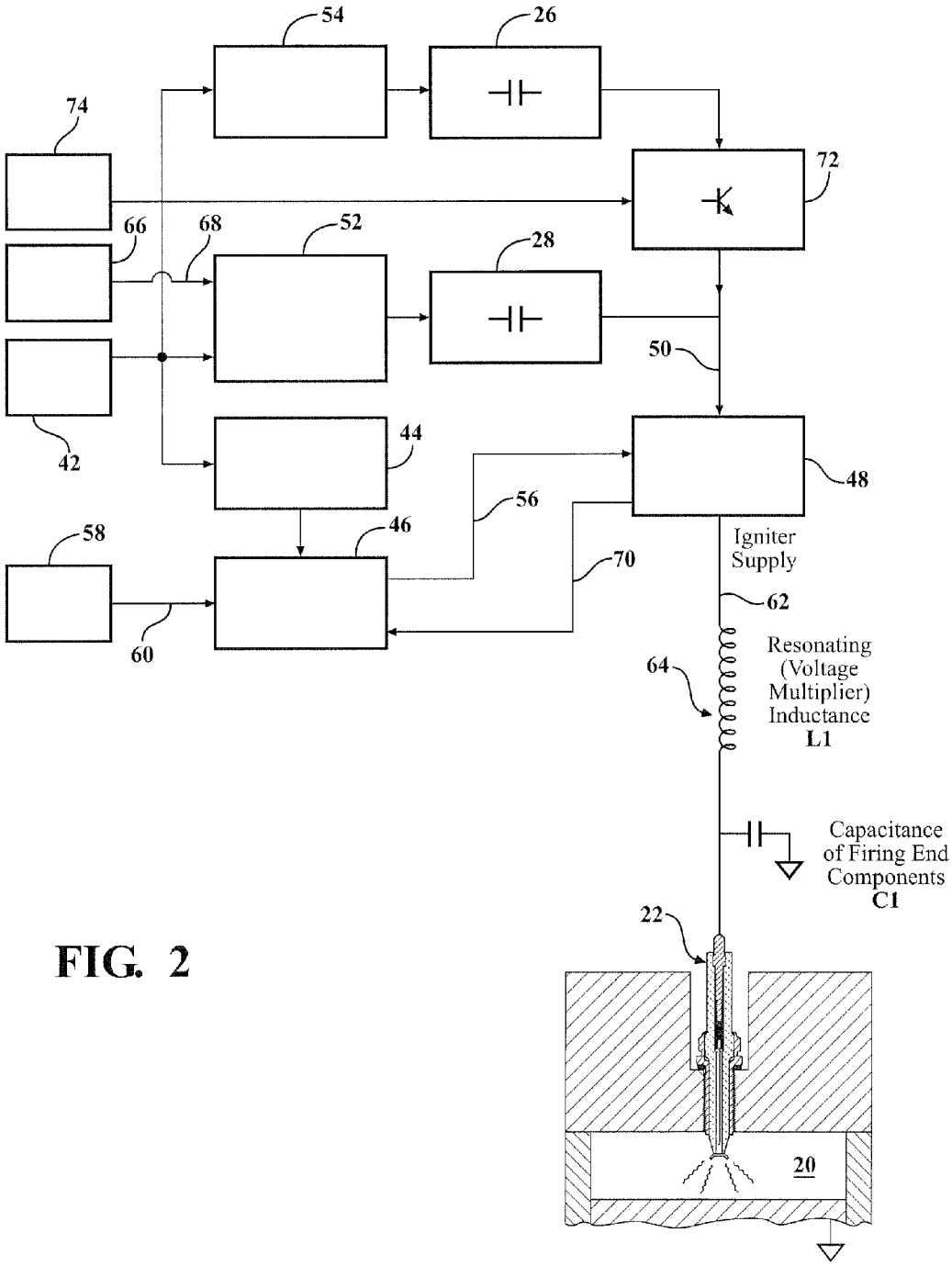
FIG. 2 is a diagram showing electronic components of the corona discharge ignition according to one embodiment of the invention.
Figure 3:
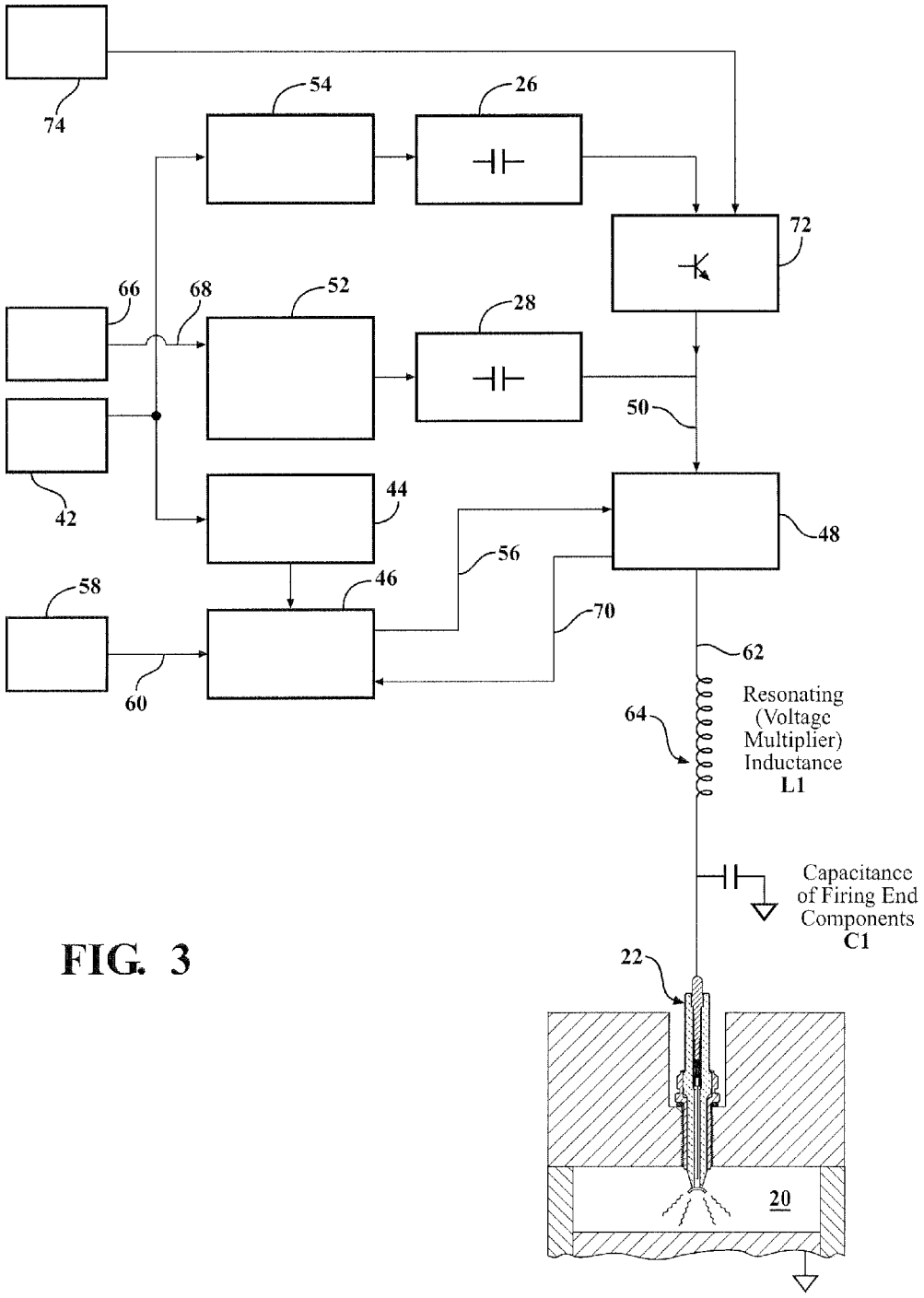
FIG. 3 is a diagram showing electronic components of the corona discharge ignition according to another embodiment of the invention.

As shown in FIGS. 2 and 3, the electronics of the corona ignition system include a power supply 42, a low voltage energy supply 44, an igniter drive circuit 46, an igniter driver 48, a controlled high voltage energy supply 52, the main energy storage 28, a fixed high voltage energy supply 54, and the extra energy storage 26. The power supply 42 provides the energy to the high voltage energy supplies 52, 54, which provide the energy ultimately to the electrode 38 of the corona igniter 22. The power supply 42 is typically a 12 volt battery of the automotive vehicle, but can be another source of energy. In one embodiment, the power supply 42 provides the energy at an average current of 0.1 to 40 A.

The low voltage energy supply 44 receives energy from the power supply 42, stores the energy, and provides the energy at a low voltage of 0 to 24 volts to the igniter drive circuit 46. The igniter drive circuit 46 receives the energy at the low voltage from the low voltage energy supply 44 and uses the energy to transmit corona drive signals 56 to the igniter driver 48. The igniter drive circuit 46 is an oscillating circuit operating at a high frequency of 0.5 to 2.0 mega Hertz.

A drive controller 58 transmits drive control signals 60 to the igniter drive circuit 46 instructing the igniter drive circuit 46 to transmit the corona drive signals 56. The drive controller 58 is typically integral with an engine control unit of the automotive vehicle, but can be a separate unit. The corona drive signals 56 instruct the igniter driver 48 to provide the energy to the LC circuit 64 and ultimately to the corona igniter 22 at a predetermined time, duration, voltage level, and resonant frequency. While the system is providing the corona discharge 24, the energy received by the igniter driver 48 is from the main energy storage 28, but not the extra energy storage 26. The energy provided by the main energy storage 28 alone allows the corona igniter 22 to provide the corona discharge 24 igniting the combustible mixture.

The main energy storage 28 receives the energy from the controlled high voltage energy supply 52, which receives energy from the power supply 42. The controlled high voltage energy supply 52 provides pulses of the energy to the main energy storage 28, which provides the energy to the igniter driver 48. In the embodiment of FIG. 2, the controlled high voltage energy supply 52 receives the energy directly from the power supply 42. In the embodiment of FIG. 3, the controlled high voltage energy supply 52 does not receive the energy directly from the power supply 42 and instead receives the energy from the fixed high voltage energy supply 54, which receives the energy directly from the power supply 42. The embodiment of FIG. 3 can provide improved manufacturing and energy efficiency.

The pulses of energy are provided from the controlled high voltage energy supply 52 to the main energy storage 28 at a predetermined time, duration, and voltage level allowing the corona discharge 24 to be provided by the corona igniter 22 at a current of not greater than 10 mA. The current provided by the controlled high voltage energy supply 52 to the main energy storage 28 is referred to as a main current. In one embodiment, the controlled high voltage energy supply 52 provides the energy at a main current having an average value of 0.1 to 10 A, and at a maximum value up to 40 A.

The controlled high voltage energy supply 52 provides the energy at a voltage greater than the voltage provided by the low voltage energy supply 44. In one embodiment, the controlled high voltage energy supply 52 provides the energy at a voltage of 30 to 100V, and at a maximum voltage up to 150V. The controlled high voltage energy supply 52 has a capacitance of not greater than 5000 uF. The pulses of energy provided by the controlled high voltage energy supply 52 modulate the voltage ultimately provided to the corona igniter 22.

The system includes an energy controller 66 transmitting energy control signals 68 to the controlled high voltage energy supply 52 indicating the predetermined time, duration, and voltage level of the pulses of energy to be provided to the main energy storage 28. The output of energy from the controlled high voltage energy supply 52 can be adjusted. However, when arc discharge is formed, the controlled high voltage energy supply 52 alone is typically unable to deliver the energy a rate great enough to enhance the arc discharge to a level capable of providing a robust ignition. Particularly, the main current provided by the controlled high voltage energy supply 52 is typically not strong enough to enhance the arc discharge to a sufficient level.

In other corona ignition systems without the improved energy storage and delivery features and only a single energy storage unit, the available energy that can be delivered to the corona igniter 22 when arc discharge occurs is typically limited to the energy stored in the single energy storage unit at the time of the arc discharge formation. The energy supplied by the controlled high voltage energy supply 52 must be small enough to allow transmission of the energy from the single energy storage unit to the corona igniter 22 in a timely manner. In addition, the energy supplied by the controlled high voltage energy supply 52 may also be limited if the voltage at the controlled high voltage energy supply 52 is set to a low value for the particular operating condition where the arc discharge occurs.

The main energy storage 28 of the corona discharge ignition system receives the pulses of energy from the controlled high voltage power supply 42, stores the energy, and provides the pulses of energy to the igniter driver 48 and ultimately to the corona igniter 22. The main energy storage 28 stores a fixed amount of the energy in a capacitance at a maximum voltage of 10 to 150 volts. The maximum voltage stored by the main energy storage 28 depends on the operating conditions of the system, for example a low cylinder pressure may require a lower voltage of perhaps 20V, while a high cylinder pressure may require 100V to produce adequate corona discharge. The fixed amount of energy depends on the rate the energy is supplied to the main energy storage 28, which is controlled by and depends on the maximum value of the main current of the controlled high voltage energy supply 52.

The main energy storage 28 smoothes the current pulses required by final igniter driver 48 and corona igniter 22, so that the power supply 42 and the controlled high voltage energy supply 52 only need to supply the energy at the average current, not the maximum current. The main energy storage 28 is shown as being separate from the controlled high voltage energy supply 52, but alternatively the main energy storage 28 can be integral with the controlled high voltage energy supply 52.

The igniter driver 48 receives the corona drive signals 56 from the igniter drive circuit 46 and the energy at a voltage of 10 to 150 volts from the main energy storage 28 and provides the energy at the fixed energy supply rate, predetermined time, duration, voltage level, and resonant frequency to the LC circuit 64 and ultimately to the corona igniter 22. The energy received by the igniter driver 48 is referred to as the driver energy supply 50. The corona drive signals 56 instruct the igniter driver 48 to manipulate the driver energy supply 50 to meet the fixed energy supply rate, predetermined time, duration, voltage level, and to match the resonant frequency of the LC circuit 64. The igniter driver 48 receives the driver energy supply 50 as a DC current, manipulates the driver energy supply 50 to an AC current, and provides the AC current, referred to as the igniter energy supply 62 to the LC circuit 64 and ultimately to the corona igniter 22. The igniter energy supply 62 includes both the energy from the main energy storage 28 and the extra energy from the extra energy storage 26. The igniter driver 48 also influences the resonating inductance $L_1$ and the capacitance $C_1$ of the firing end assembly. The igniter driver 48 is shown as being separate from the igniter drive circuit 46, but alternatively can be integral with the igniter drive circuit 46.

The LC circuit 64 receives the AC current of energy from the igniter driver 48, transforms the energy, and provides the transformed energy to the corona igniter 22. During typical operating of the corona ignition system, the LC circuit 64 transforms the energy by increasing the voltage, to a level typically at least 20 times greater than the voltage of the energy received from the igniter driver 48. The LC circuit 64 also transforms the energy by decreasing the current to a level typically at least 20 times lower than the current received from the igniter driver 48. In one embodiment, the LC circuit 64 increases the voltage to 10 to 100 kilo volts, and decreases the current to 0.1 to 5 amperes.

The LC circuit 64 is provided by the resonating inductance $L_1$ and the capacitance $C_1$ of the firing end assembly, which are influenced by the igniter driver 48. A feedback signal 70 is also transmitted from the LC circuit 64 to the igniter drive circuit 46 indicating the resonant frequency of the firing end assembly. The igniter drive circuit 46 examines the information of the feedback signals 70 and uses the information to determine the predetermined time, duration, and voltage level of the energy that will be provided to the corona igniter 22. The igniter drive circuit 46 also uses the information in the feedback signals 70 to determine the resonant frequency of the energy provided, so that he resonant frequency matches the resonant frequency of the LC circuit 64.

During typical operation of the corona ignition system, the electrode 38 of the corona igniter 22 typically receives the energy from the LC circuit 64 at a radio frequency of 0.5 to 2.0 MHz and a high voltage of 10 to 100 kV. The electrode 38 then emits the energy as a radio frequency electric field to ionize the combustible mixture and provide the corona discharge 24 igniting the fuel-air mixture, wherein the corona discharge 24 has a voltage of 10 to 100 kV and a current of less than 10 mA. However, in certain instances, such as when engine operating conditions change, the current increases, the electric field loses all dielectric properties, and the corona discharge 24, which is a non-thermal plasma, transitions to a thermal plasma, referred to as the arc discharge. The arc discharge extends between the electrode 38 and grounded cylinder walls, piston 36, or other portion of the corona igniter 22. The arc discharge can be intentional, but is typically unintentionally induced by a changing operating condition of the system, since arc discharge is typically not sufficient to provide reliable ignition. Any method can be used to detect the occurrence of the arc discharge. When arc discharge occurs, the system delivers the extra energy stored in the extra energy storage 26 to the corona igniter 22 to enhance the arc discharge and thus improve the reliability of ignition until the corona discharge 24 is restored.

As shown in FIGS. 2 and 3, the extra energy storage 26 receives the energy from the fixed high voltage energy supply 54, which receives the energy from the power supply 42. The fixed high voltage energy supply 54 provides the energy to the extra energy storage 26 at a voltage of 100 to 200 V and at a maximum current of 40 A. In the embodiment of FIG. 3, the fixed high voltage energy supply 54 also provides the energy received from the power supply 42 to the controlled high voltage energy supply 52, as the controlled high voltage energy supply 52 does not receive the energy directly from the power supply 42. This embodiment can provide improved manufacturing and energy efficiency.

The energy provided from the fixed high voltage energy supply 54 to the extra energy storage 26 is typically set to be at or close to the maximum possible voltage attainable by the controlled high voltage energy supply 52. In one embodiment, the voltage provided by the fixed high voltage energy supply 54 differs from the maximum voltage attainable by the controlled high voltage energy supply 52 by not greater 5% of the maximum voltage attainable by the controlled high voltage energy supply 52. The fixed high voltage energy supply 54 can continuously provide energy to the extra energy storage 26 such that the extra energy storage 26 remains fully charged.

The extra energy storage 26 receives the energy from the fixed high voltage energy supply 54 and stores the energy in a capacitance at a voltage of 100 to 200 volts, referred to as the second extra voltage. The extra energy storage 26 is preferably equal to the maximum voltage capable of being maintained by the extra energy storage 26. The second extra voltage is typically 1.1 to 10 times greater than the first main voltage, or 1.1 to 10 times greater than the maximum voltage that can be stored by the main energy storage 28. In one embodiment, the second extra voltage is 150 to 200 volts. The fixed high voltage energy supply 54 provides the energy to the extra energy storage 26 such that the extra energy storage 26 maintains the second extra voltage. The fixed high voltage energy supply 54 also provides the energy to the extra energy storage 26 at a current, referred to as an extra current, which is greater than the main current.

The extra energy storage 26 is typically not connected to the controlled high voltage energy supply 52 and thus does not need to be limited in size, which allows the extra energy storage 26 to deliver more energy to the corona igniter 22 than the main energy storage 28. In addition, the extra energy storage 26 is independent of operating conditions of the system and thus can be kept charged to the maximum voltage capable of being maintained by the extra energy storage 26, independent of the system operating conditions. In an alternate embodiment, the extra energy storage 26 can be a charge added to the charge stored in the output capacitance of the power supply 42.

A switch 72 is disposed between the extra energy storage 26 and the igniter driver 48 to prevent the extra energy from being delivered to the igniter driver 48 when corona discharge 24 is being provided by the electrode 38 and effectively igniting the combustible mixture. The switch 72 is typically an electronic switch 72 containing a field-effect transition (fet), bipolar junction transistor (bjt), insulated gate bipolar transistor (igbt), silicon controlled rectifier (scr), or other semiconductor device. Alternatively, the switch 72 can be mechanical, such as a relay. When arc discharge is detected, the switch 72 is closed to deliver the extra energy to the igniter driver 48. Thus, the driver energy supply 50 includes both the energy from the main energy storage 28 and the extra energy from the extra energy storage 26. The extra energy is delivered to the igniter driver 48 and ultimately to the electrode 38 of the corona igniter 22 to enhance the arc discharge and offset the reduced ignition efficiency of arc discharge over corona discharge 24. The extra energy typically enables the arc discharge to ignite the combustible mixture and ensure reliable ignition until the corona discharge 24 is restored. When the extra energy is delivered to the igniter driver 48, the extra energy storage 26 is immediately recharged to the maximum voltage by the fixed high voltage energy supply 54 so that the system is ready to deliver the extra energy again upon the next occurrence of arc discharge.

During typical operation of the corona ignition system, the switch 72 is open to prevent the extra energy from being provided to the igniter driver 48, and then closed to deliver the extra energy on demand when arc discharge occurs. The system includes a switch control 74 instructing the switch 72 to remain open during the corona discharge 24 and to close when arc discharge occurs.

When the arc discharge occurs, the extra energy is provided from the extra energy storage 26, past the switch 72, and to the igniter driver 48. The igniter driver 48 simultaneously receives the energy from the main energy storage 28 and the extra energy from the extra energy storage 26 in the driver energy supply 50, along with the corona drive signals 56 from the igniter drive circuit 46. The igniter driver 48 then provides the energy to the LC circuit 64 according to the predetermined rate, time, duration, voltage level, and resonant frequency conveyed in the corona drive signals 56. The igniter driver 48 receives the energy from the energy storages 26, 28 as a DC current and manipulates the energy to an AC current, which is provided to the LC circuit 64. The LC circuit 64 also transforms the energy before providing the energy to the corona igniter 22. The LC circuit 64 increases the voltage to enhance and maintain the arc discharge over at least one engine cycle and until the corona discharge 24 is restored.

When arc discharge occurs, the stored energy is typically provided from the extra energy storage 26 to the corona igniter 22 within 10 microseconds of detecting the arc discharge. The corona igniter 22 simultaneously receives the energy from both the main energy storage 28 and the extra energy storage. The corona igniter 22 then emits the energy as the arc discharge at a current of 25 to 500 mA to ignite the combustible mixture.

Another aspect of the invention provides a method for igniting a combustible mixture of fuel and air in a combustion chamber 20 employed in the corona ignition system. The method includes supplying the energy to the main energy storage 28 at the main current, and storing energy in the main energy storage 28 at the first main voltage. The method further includes providing the energy from the main energy storage 28 ultimately to the electrode 38, allowing the electrode 38 to emit a radio frequency electric field to ionize the combustible mixture and provide the corona discharge 24 igniting the combustible mixture.

The method also includes supplying the energy to the extra energy storage 26 at the extra current, which is greater than the main current. The method then includes storing energy in the extra energy storage 26 at the second extra voltage, which is greater than the first main voltage. The method further includes providing the energy from the extra energy storage 26 to the electrode 38 only when the arc discharge occurs to enhance the arc discharge. While the corona discharge 24 is being provided by the system, the method includes preventing the energy from the extra energy storage 26 from being provided to the electrode 38. The switch 72 is open to prevent delivery of the extra energy from the extra energy storage 26 to the corona igniter 22 when the corona discharge is provided, and the method includes closing the switch 72 to provide the extra energy to the corona igniter 22 only when the arc discharge occurs. The method also includes maintaining the extra energy storage 26 fully charged so that the system is ready to provide the extra energy on demand.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A corona discharge ignition system for igniting a combustible mixture of fuel and air in a combustion chamber, comprising:

an electrode for receiving energy at a radio frequency voltage and emitting a radio frequency electric field to ionize the combustible mixture and provide a corona discharge igniting said combustible mixture, a main energy storage storing energy at a first main voltage and providing the energy ultimately to said electrode, and an extra energy storage storing energy at a second extra voltage that is greater than said first main voltage and operative in response to an occurrence of an arc discharge at said electrode for providing said stored energy ultimately to said electrode.

2. The system of claim 1 including a switch between said extra energy storage and said electrode to prevent the energy of said extra energy storage from being provided to said electrode while said corona discharge is provided.

3. The system of claim 2 including a switch control instructing said switch to remain open when said corona discharge is provided and to close when said arc discharge occurs, wherein said closed switch allows the energy of said extra energy storage to be provided to said electrode.

4. The system of claim 3 including a detector for detecting said arc discharge, and wherein said switch control instructs said switch to close upon the detection of said arc discharge.

5. The system of claim 1 wherein said second extra voltage is at least 1.1 times greater than said first main voltage.

6. The system of claim 1 including a power supply and a controlled high voltage energy supply providing the energy from said power supply to said main energy storage at said first main voltage and a fixed high voltage energy supply separate from said controlled high voltage energy supply providing the energy from said power supply to said extra energy storage at said second extra voltage.

7. The system of claim 6 wherein said fixed high voltage energy supply maintains said extra energy storage fully charged.

8. The system of claim 1 wherein said first main voltage provided by said controlled high voltage energy supply is between 10 V to 100 V and said second extra voltage provided by said fixed high voltage supply is between 100 to 200 V.

9. The system of claim 1 including an igniter drive circuit and a igniter driver, wherein said igniter drive circuit transmits corona drive signals to said igniter driver, said corona drive signals indicate a predetermined time, duration, voltage level, and resonant frequency of the energy ultimately provided to said electrode, said igniter driver receives said corona drive signals and the energy from said main energy storage and provides the energy at the predetermined time, duration, voltage level, and resonant frequency ultimately to said electrode.

10. The system of claim 9 including an LC circuit receiving the energy from said igniter driver and increasing the voltage and decreasing the current prior to providing the energy to said electrode.

11. The system of claim 9 wherein said igniter drive circuit is an oscillating circuit operating at a high frequency of between 0.5 to 2.0 MHz.

* * * * *